US006739114B2

(12) United States Patent
Shaffer

(10) Patent No.: US 6,739,114 B2
(45) Date of Patent: May 25, 2004

(54) FEMININE HYGIENE DISPOSAL METHOD

(76) Inventor: Kristin M. Shaffer, 9296 W. Calico St., Boise, ID (US) 83709

( * ) Notice: Subject to any disclaimer, the term of this patent is extended or adjusted under 35 U.S.C. 154(b) by 0 days.

(21) Appl. No.: 10/124,511

(22) Filed: Apr. 16, 2002

(65) Prior Publication Data

US 2003/0192290 A1 Oct. 16, 2003

(51) Int. Cl.[7] ..... B65B 11/58

(52) U.S. Cl. ..... 53/449; 53/459; 53/475; 53/571; 53/244; 220/908.3; 220/495.5; 220/495.7; 220/495.8; 232/43

(58) Field of Search ..... 53/449, 459, 475, 53/171, 173, 175, 571, 244, 260, 253; 383/33, 43, 66; 232/43.2; 220/908.1, 908.3, FOR 115, FOR 116, FOR 119, 495.1, 495.05, 495.06, 495.07, 495.08

(56) References Cited

U.S. PATENT DOCUMENTS

| | | | | | |
|---|---|---|---|---|---|
| 1,907,082 | A | * | 5/1933 | Meltzer | 220/495.06 |
| 3,218,014 | A | | 11/1965 | Frazier | |
| 3,322,477 | A | * | 5/1967 | Armijo | 232/43.2 |
| 3,836,037 | A | * | 9/1974 | Bass | 220/495.08 |
| 4,427,110 | A | * | 1/1984 | Shaw, Jr. | 220/908.3 |
| 4,592,192 | A | * | 6/1986 | Jacob et al. | 53/512 |
| 4,603,791 | A | * | 8/1986 | Spierer et al. | 383/43 |
| 4,838,327 | A | | 6/1989 | Ambler et al. | |
| 4,948,266 | A | * | 8/1990 | Bencic | 220/495.08 |
| 5,027,578 | A | * | 7/1991 | Natterer et al. | 53/512 |
| 5,193,684 | A | | 3/1993 | McDonald | |
| 5,287,960 | A | | 2/1994 | Kalb et al. | |
| 5,540,351 | A | * | 7/1996 | Luescher | 220/495.07 |
| 5,799,909 | A | | 9/1998 | Ziegler | |
| 6,059,100 | A | | 5/2000 | Jones | |
| 6,120,743 | A | | 9/2000 | Papari | |

FOREIGN PATENT DOCUMENTS

JP 02023101 A * 1/1990 ..... B65F/1/06

OTHER PUBLICATIONS

Sani Personal Disposal Bags White Full Image, 1 Page, Printed Mar. 28, 2002, http://www.tecprod.com/cat/im1920.htm.

Sanifloor White Twin Floor Disposal Unit, 1 Page, Printed Mar. 28,2002, http://www.tecprod.com/cat/fx190018.htm.

Gamco—Nv–1nd Sanitary Napking Vendors, 1 Page.

Gamco—Nd–5 Sanitary Napkin Disposal For Surface Mounting, 1 Page.

American Specialties, Inc., Surface Mounted Sanitary Napkin Disposal Model No. 0852.

American Specialties, Inc., Surface Mounted Sanitary Napkin Disposal Model No. 0473–A.

* cited by examiner

*Primary Examiner*—Stephen F. Gerrity
(74) *Attorney, Agent, or Firm*—Stephen M. Nipper; Frank J. Dykas; Robert L. Shaver

(57) ABSTRACT

A feminine hygiene disposal unit for sanitary receipt and disposal of used sanitary products. The unit has a disposal bag dispenser, at least one disposal bag, a receptacle, and a liner for the receptacle. This liner having a lid flap having an opening therethrough, this lid flap being supported through use of a pair of sandwiching flanges for sandwiching the lid flap in a generally horizontal orientation.

7 Claims, 5 Drawing Sheets

FEMININE HYGIENE DISPOSAL METHOD

BACKGROUND OF THE INVENTION

1. Field of the Invention

The present invention generally relates to refuse disposal systems, and more particularly relates to refuse disposal systems for the hygienic disposal of sanitary napkins and the like.

2. Background Information

The disposal of tampons, sanitary napkins and other types of sanitary products in a hygienic manner is a frequent issue in public restrooms for operators and maintainers of said facilities. If sanitary products are disposed of a sewage or septic system problems such as sewage pipe blockage can occur, causing backups and overflows of plumbing components.

As a result, building maintenance operators often provide special waste receptacles for deposition therein said used sanitary products. Numerous special waste receptacles and manners of sanitary disposal have been invented and are currently utilized. For instance, it is known to use a provided small wax paper bag for deposition of the used sanitary products therein, this wax paper bag being folded shut and placed in a standard garbage receptacle. Another example is a enamel metal floor receptacle having a hinged lid. Also known are floor or wall mounted receptacles having hinged doors.

With such prior art units, in order to operate the unit the user must open a lid that has been touched by others with soiled hands. The potential for transmittal of wet or dried bodily fluids from user to user is very high, thus making the operation of the unit unsanitary. Another issue is the fact that oftentimes discarded waste from previous users can be visible to the next user. This particularly occurs where the previous user(s) may not have been careful to "hide" their discarded waste with the folding of their feminine hygiene product and/or wrapping toilet paper around the feminine hygiene product, thus making the container unsightly. Even with the wrapping of toilet paper around the discarded waste, sanitary napkins in particular are prone to "re-open" themselves and produce and unsightly and unsanitary condition. In addition, the "re-opened" sanitary napkins can be hanging outside of the waste container, thus making the container unsightly and unsanitary to other users.

The current prior art units are too small in capacity to house frequent use, thus making them unreliable to hold large amounts of waste in restrooms such as those found in restaurants, shopping malls, etc. If the waste container is not emptied frequently by janitorial staff, the container becomes full. Janitorial staff, particularly when the waste container is unsightly or unclean, can intentionally neglect proper maintenance of this receptacle rather than dealing with the mess. Also, a full container deters future users from using such a means of disposal, thus some users look for other means to dispose of their feminine hygiene products (often times through the plumbing system), which can cause additional problems for the owners of the facility.

Due to unsanitary conditions of the current means of disposal and the unreliability of the units, users often discard their waste through the plumbing system as noted above. This will often clog plumbing systems, requiring the emergency visit of a plumber to solve the problem. Thus resulting in added expense to the owners of the facility.

One of the more prevalent current models of waste containers for the discarding of feminine hygiene products is a floor-based model in which the placement of this container is oftentimes out of reach of the user who is positioned on the toilet. The user is apt to discard of her waste through the use of the plumbing system because of this inconvenience. As noted in the above paragraph, this can result in added expense to the owners.

With the current means of disposing feminine hygiene products, the janitorial staff is faced with the daunting task of removing the discarded waste products and cleaning the waste container. Dried bodily fluid residue is oftentimes on the outside housing of the container and on the floor surrounding the container as waste products will at times fall onto the floor due to the unreliable nature of the current waste containers.

What is needed is a method and apparatus for sanitary napkin disposal which provides for sanitary operation of the unit, hides waste from subsequent users, is reliable, is inexpensive, is convenient, and is easily changed out and unnecessary to clean. The present invention solves these needs.

SUMMARY OF THE INVENTION

The present invention is a feminine hygiene disposal unit for sanitary receipt and disposal of used sanitary products. While the intended use of the present invention is for the disposal of said used sanitary products, the present invention could also serve as a trash or other receptacle in general.

The present invention provides for a fresh, clean surface for each use. A user is not required to touch any part of the invented unit in order to utilize the present invention, thus making it more sanitary than current models used for feminine hygiene waste and/or sanitary product disposal. Through use of the present invention, previously discarded feminine hygiene products are not visible to subsequent users. It is preferred that the waste containing housing of the present invention be large enough to hold the capacity of frequent use. Additionally, through use of the present invention, the discarded feminine hygiene products are compacted into smaller units (in bags), taking up less space than with the current models.

The present invention's preferred lack of a hinged lid allows for the 'clean' discard of feminine hygiene products, thereby reducing the likelihood of discarded waste hanging out of the bin or soiling the outside surfaces of the housing. The simplicity and intrinsic nature of use of the present invention ultimately will reduce costs with less plumbing system maintenance fees, as well as reduced usage of toilet paper traditionally used to wrap feminine hygiene products.

The placement of the invented unit, at the shoulder of the user seated on the toilet, and the absence of having to manually open and close the unit, makes for simple and convenient operation, thereby encouraging its use. Loading of the individual use disposal bags is as easy as loading a restaurant napkin dispenser. The waste container or receptacle is easily and sanitarily changed out as the used receptacle liner slides out the front of the unit and the new liner is easily slid in. Since the very nature of this unit is to provide a sanitary means of disposing feminine hygiene products, the outside of the housing will remain clean, thereby making a daily cleaning of the outside of the unit unnecessary.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
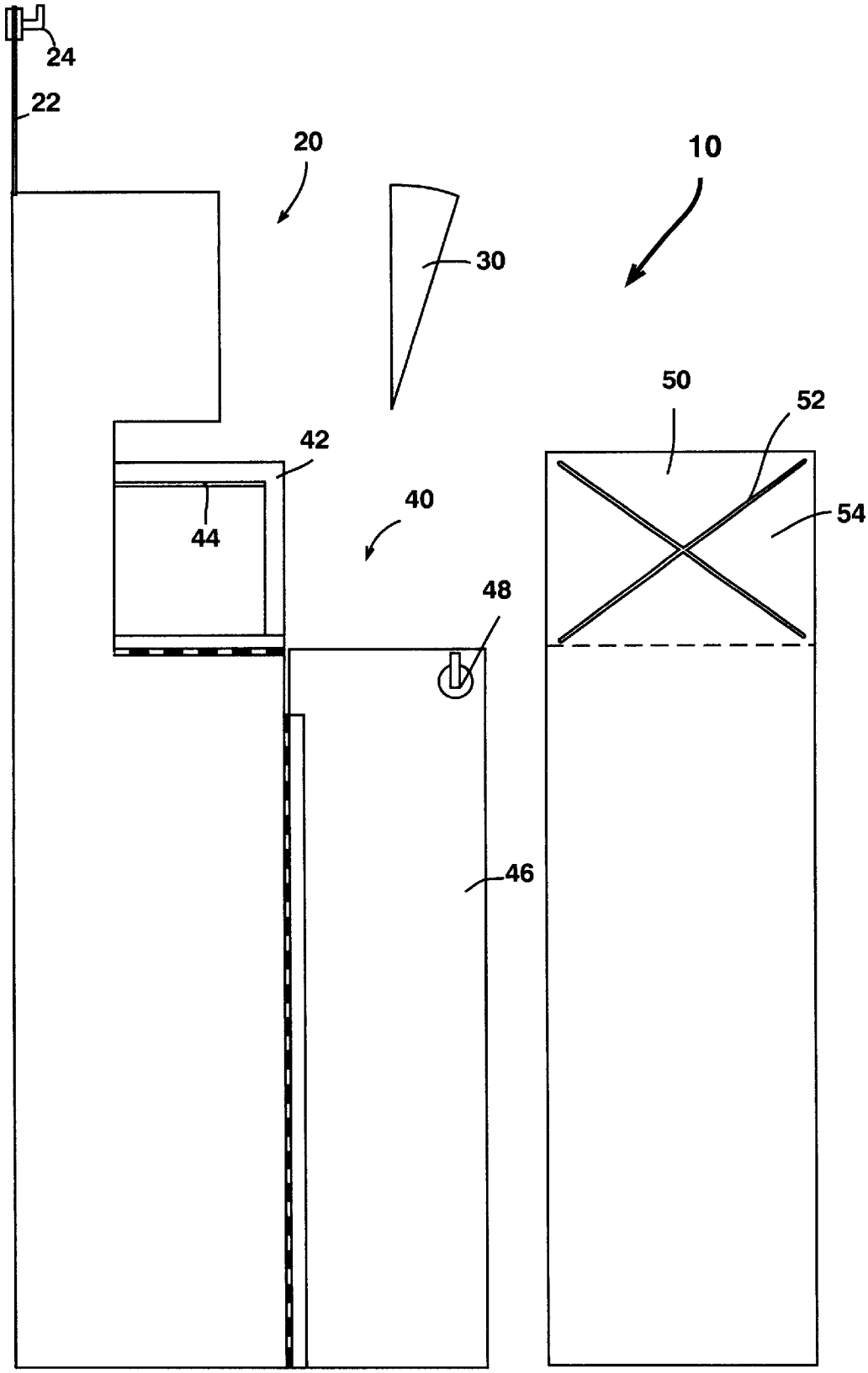
FIG. 1 is an exploded side view of the preferred embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a feminine hygiene disposal unit for sanitary receipt and disposal of used sanitary products. Referring initially to FIG. 1 the invented sanitary disposal unit 10 comprises a disposal bag dispenser 20 for dispensing disposal bags, at least one disposal bag 30 for receiving therein used sanitary products, a receptacle 40 for holding a disposable receptacle liner, and a disposable receptacle liner 50 for receiving therein said used disposal bags.

In the embodiment shown, the disposal bag dispenser 20 and the receptacle 40 are integrally built into or as part of a unitary frame or housing, however other embodiments are also envisioned wherein the disposal bag dispenser 20 will be separate from the receptacle 40. The preferred fabrication of the frame/disposal bag dispenser/receptacle is stainless steel, however other materials may also be used, including but not limited to plastic.

The disposal bag dispenser 20 is utilized to hold at least one (and preferably a plurality of) disposal bag 30. In the embodiment shown, a pair of flanges 21, 23 define an opening therethrough which allow disposal bags 30 to be placed within the disposal bag dispenser 20 and retrieved through said opening. Other means for dispensing said disposal bags are also envisioned. Alternatively, a spring or other biasing means may be used to bias the disposal bags against the opening, as defined by the flanges 21, 23.

In use, the user would remove the front most disposal bag and succeeding disposal bag would then be pushed forward to replace the bag taken. It is preferred to configure the disposal bag dispenser so that disposal bags 30 held therein may be removed one at a time without a user touching any disposal bag other than the front most disposal bag.

Preferably, a door 22 or other access opening is provided within the disposal bag dispenser 20 so that a maintenance worker may open said disposal bag dispenser in order to replenish the disposal bags held therein. The embodiment shown shows a lock or latch 24 for fixing the disposal bag dispenser door or lid 22 in a closed position thereby enclosing the bag dispenser 20. In the embodiment shown, the bag dispenser, is located at the top of the housing, however other placements and orientations of the bag dispenser are also envisioned.

Also utilized with the present invention is at least one disposal bag 30 into which a user places the used sanitary product to be disposed of. Such a disposal bag 30 preferably has a closed end and an opened end and consists of enough material so that the used sanitary product can be placed therein and the open end folded so that it is closed. It is preferred that such a disposal bag be made of a fluid resistant material, such as waxed paper, glycine, plastic, or other matter to prevent fluids from leaking out of the disposal bag. In a less preferred embodiment, such a disposal bag could be plastic and be dispensed on a roll. It is preferred that the rear wall of the bag be slightly taller than the front wall of the bag so that a user can stick her finger into the disposal bag and pull on the front wall of the bag to remove the disposal bag from the dispenser. In such a manner, the succeeding disposal bag is left sterile for the next user.

Figure 2:
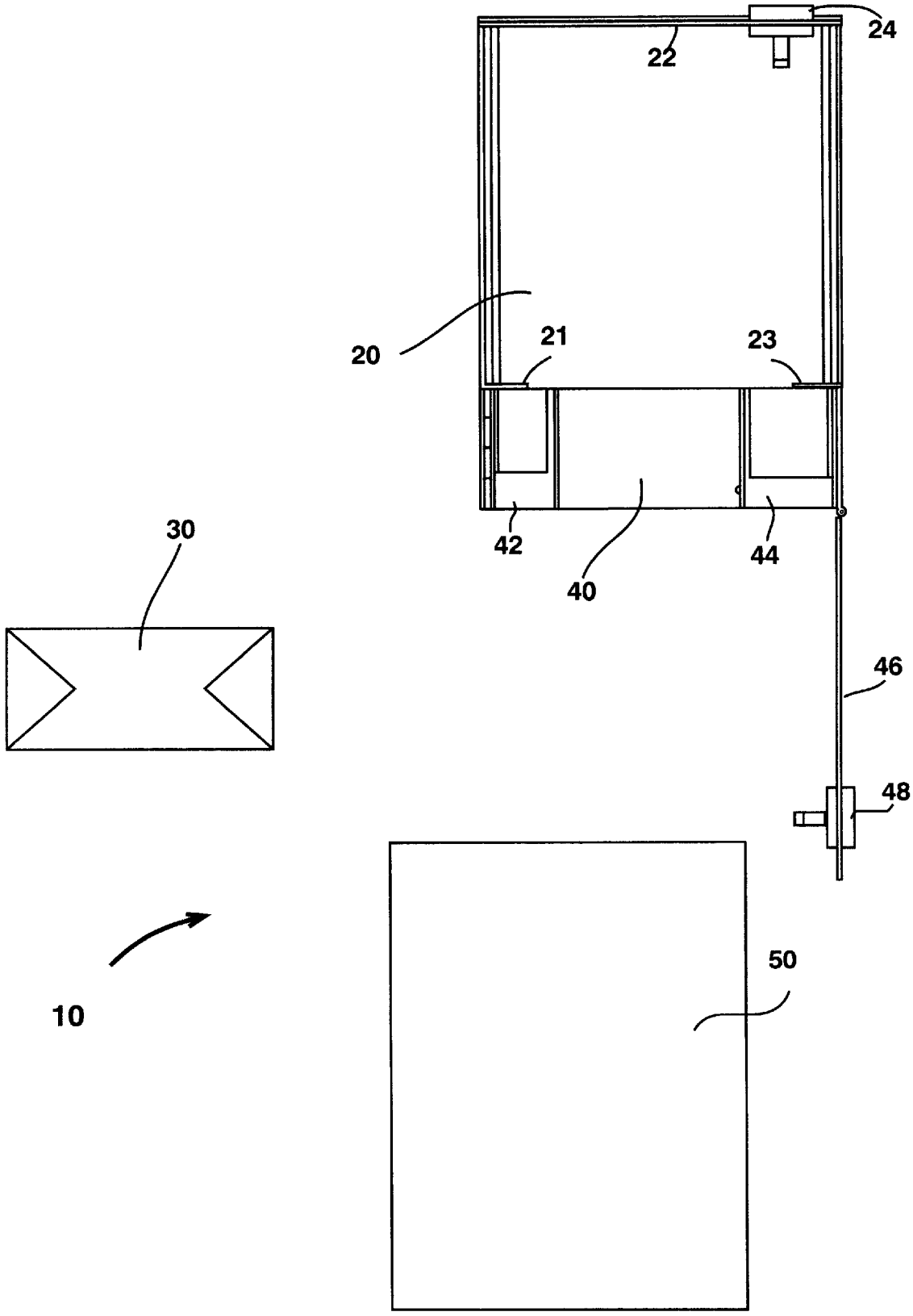
FIG. 2 is an exploded top view of the preferred embodiment of the present invention.

Referring now to FIG. 2, the present invention further comprises a receptacle 40. This receptacle 40 for receiving therein a disposable receptacle liner 50. In the preferred embodiment, the receptacle 40 comprises a lid flap first flange 42 and a lid flap second flange 44. It is preferred that these lid flap flanges be configured for receipt in a sandwiching manner the lid flap 54 of the disposable receptacle liner 50. For example, the lid flap second flange 44 would be pivoted on its hinge to a generally horizontal position, the liner's lid flap 54 would be laid over on top of the lid flap first flange 44, and then the lid flap first flange 42 would be laid on top of the lid flap 54. By sandwiching the lid flap in such a manner, the lid flap 54 of the disposable receptacle liner 50 is held in a generally horizontal position so that a user could drop a filled disposal bag 30 through the opening 52 of the disposable receptacle liner 50. This sandwiching assembly provides structural stability and support to the disposable receptacle liner 50. The assembly will hold the disposable receptacle liner in an open position as well as provide support for the top lid flap 54 of the liner 50 for when articles are dropped through the "X"-shaped slit.

Figure 3:
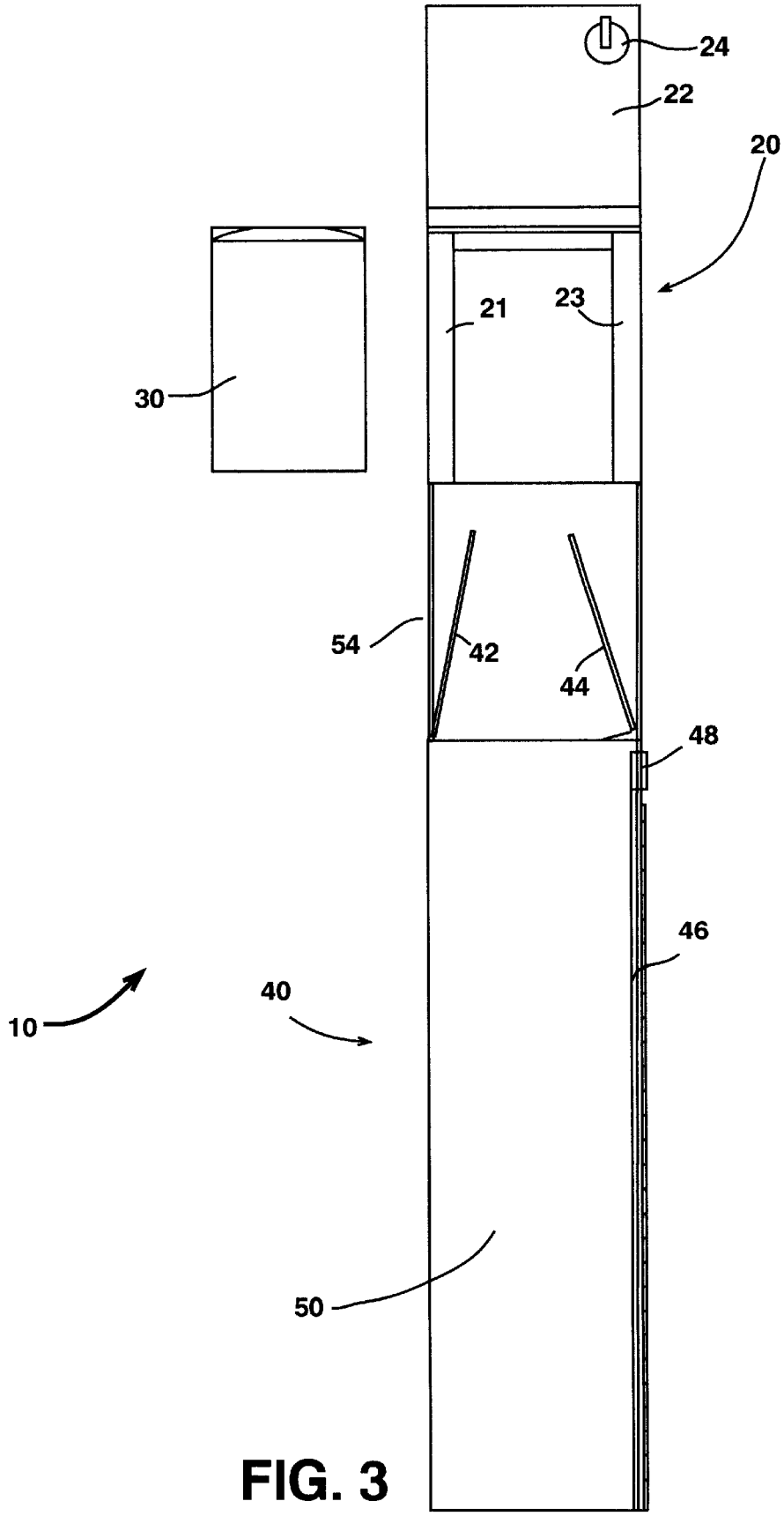
FIG. 3 is an exploded front view of the preferred embodiment of the present invention.

Referring now to FIG. 3, it is preferred that the receptacle 40 further comprise at least one door 46, such a door having a latch or lock 48. Such a receptacle thereby defining a receptacle inside chamber able to receive therein the disposable receptacle liner 50.

The preferred disposable receptacle liner 50 comprises a generally rectangular box having a top surface with at least one opening 52 therethrough further having a lid flap 54 which is able to be folded over. This lid flap 54 further having an opening 52 defined therethrough. The preferred opening 52 comprises a pair of diagonal slots therethrough, such as those shown in the figures. However, other manners of openings are also envisioned. The benefit of using such an X-shaped opening is that the opening would allow used disposal bags to be dropped therethrough with the opening generally returning to its original shape. This would also function to block viewing of the contents of said disposable receptacle liner by subsequent users. It is preferred that the disposable receptacle liner be made of wax-coated paper or plastic. In the embodiment shown, the disposable receptacle liner is placed within the receptacle 40 by opening the front door 46 of the receptacle and sliding the bag 50 into place, "sandwiching" the lid flap 54 of the bag 50 (containing the "X"-shaped slit) between two lid flap flanges 42, 44 to allow for structural stability.

In use, while sitting on the toilet, the user conveniently reaches over to pull an individual disposal bag from the spring-loaded bag dispenser at the top of the unit. The user then places her used feminine hygiene product into the bag and scrunches or folds it closed. She then drops the bag through the "X"-shaped slit in the waste receptacle located at the bottom of the unit.

Figure 4:
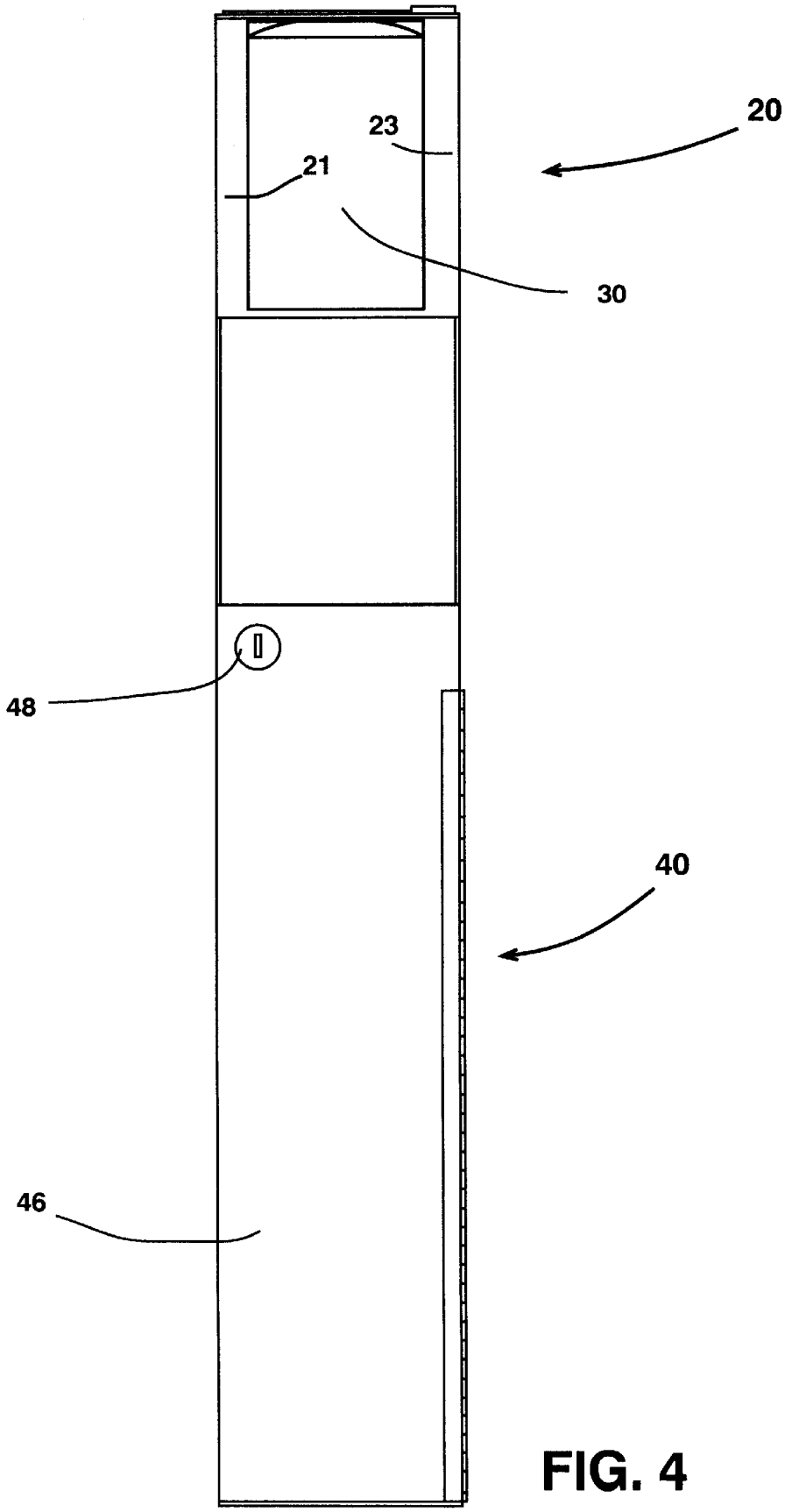
FIG. 4 is a assembled front view of the preferred embodiment of the present invention.
Figure 5:
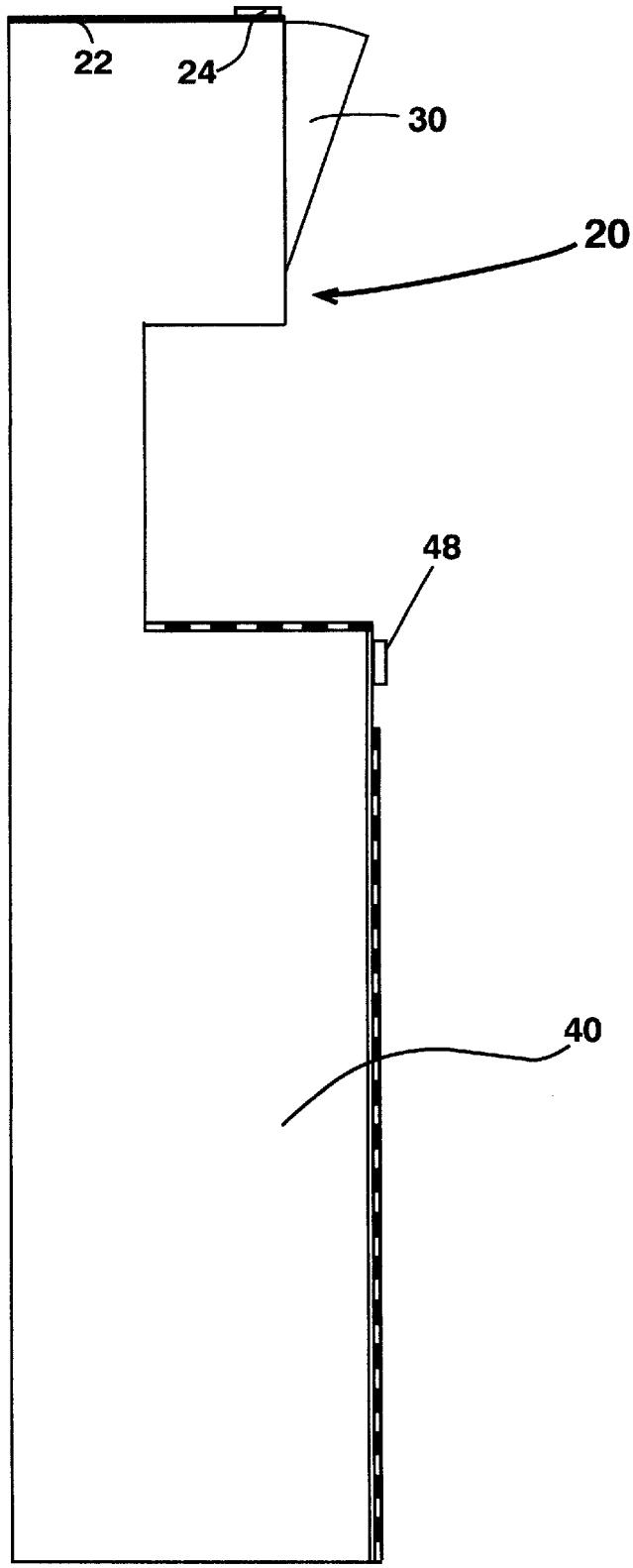
FIG. 5 is a assembled side view of the preferred embodiment of the present invention.

FIG. 1 shows the side exploded view of the preferred embodiment of the present invention. FIG. 2 shows a top exploded view of the preferred embodiment of the present invention. FIG. 3 shows a front exploded view of the preferred embodiment of the present invention. FIG. 4 shows a front view of the preferred embodiment of the present invention, as installed together. FIG. 5 shows a side view of the preferred embodiment of the present invention, as installed together.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A sanitary disposal method for disposal of a used sanitary feminine hygiene product, said method comprising the steps of:

(a) providing a disposal bag dispenser for dispensing at least one disposal bag;

(b) providing within said disposal bag dispenser at least one disposal bag for receipt of said used sanitary feminine hygiene product;

(c) providing a receptacle for receiving said disposal bag;

(d) providing within said receptacle a disposable receptacle liner for lining said receptacle, said receptacle liner further comprising a lid, said lid comprising an opening defined within said lid;

(e) removing a disposal bag from said dispenser;

(f) placing said used sanitary feminine hygiene product within said disposal bag; and (g) placing said disposal bag through said opening and into said receptacle liner.

2. The sanitary disposal method of claim 1, wherein said opening comprises at least one slot within said lid.

3. The sanitary disposal method of claim 1, wherein said opening comprises an X-shaped slot within said lid.

4. The sanitary disposal method of claim 1, further comprising the step of:

providing a housing, wherein said disposal bag dispenser and said receptacle attach to said housing.

5. A sanitary disposal method for disposal of a used sanitary feminine hygiene product, said method comprising the steps of:

(a) providing a disposal bag dispenser for dispensing at least one disposal bag;

(b) providing within said disposal bag dispenser at least one disposal bag for receipt of said used sanitary feminine hygiene product;

(c) providing a receptacle for receiving said disposal bag;

(d) providing within said receptacle a disposable receptacle liner for lining said receptacle, said receptacle liner comprising a generally rectangular bottom wall, four side walls extending from said bottom wall, wherein adjacent side walls connect with one another and said bottom wall to form an open topped rectangular box, said receptacle liner further comprising a lid attaching to one of said walls adjacent said open top, said lid comprising an opening defined within said lid;

(e) removing a disposal bag from said dispenser;

(f) placing said used sanitary feminine hygiene product within said disposal bag; and (g) placing said disposal bag through said opening and into said receptacle liner.

6. The sanitary disposal method of claim 5, wherein said opening comprises at least one slot within said lid.

7. The sanitary disposal method of claim 5, wherein said opening comprises an X-shaped slot within said lid.

* * * * *